US012595644B2

(12) United States Patent
Yang et al.

(10) Patent No.: US 12,595,644 B2
(45) Date of Patent: Apr. 7, 2026

(54) NOISE-REDUCING INSTANT HEATING AND DRYING-TYPE FAUCET

(71) Applicant: GUANGDONG AINI INTELLIGENT HOUSEHOLD ELECTRICAL APPLIANCE MANUFACTURING CO., LTD., Foshan (CN)

(72) Inventors: Fei Yang, Foshan (CN); Yucong Yang, Foshan (CN); Yumin Mo, Leizhou (CN)

(73) Assignee: GUANGDONG AINI INTELLIGENT HOUSEHOLD ELECTRICAL APPLIANCE MANUFACTURING CO., LTD., Foshan (CN)

( * ) Notice: Subject to any disclaimer, the term of this patent is extended or adjusted under 35 U.S.C. 154(b) by 108 days.

(21) Appl. No.: 18/662,765

(22) Filed: May 13, 2024

(65) Prior Publication Data

US 2024/0344304 A1 Oct. 17, 2024

Related U.S. Application Data

(63) Continuation of application No. PCT/CN2022/091429, filed on May 7, 2022.

(30) Foreign Application Priority Data

Apr. 29, 2022 (CN) ..... 202210466009.6

(51) Int. Cl.

| | |
|---|---|
| ***E03C 1/04*** | (2006.01) |
| ***A47K 10/48*** | (2006.01) |
| ***E03C 1/044*** | (2006.01) |

(52) U.S. Cl.

CPC ..... *E03C 1/0404* (2013.01); *A47K 10/48* (2013.01); *E03C 1/044* (2013.01)

(58) Field of Classification Search

CPC .... A47K 2210/00; A47K 10/48; E03C 1/0404

See application file for complete search history.

(56) References Cited

U.S. PATENT DOCUMENTS

| | | | | |
|---|---|---|---|---|
| 9,518,681 | B2 * | 12/2016 | Williamson | F16L 3/00 |
| 10,450,732 | B2 * | 10/2019 | Xia | F16K 19/006 |

FOREIGN PATENT DOCUMENTS

| | | | |
|---|---|---|---|
| CN | 201982763 | U | 9/2011 |
| CN | 103822008 | A | 5/2014 |
| CN | 208041292 | U | 11/2018 |

(Continued)

*Primary Examiner* — Janie M Loeppke

(74) *Attorney, Agent, or Firm* — Birchwood IP

(57) ABSTRACT

Disclosed is a noise-reducing instant heating and drying-type faucet, including a water inlet device, a hot air water outlet device and a filter cap assembly, where the hot air water outlet device is located at the upper end of the water inlet device, the hot air water outlet device includes a housing, the housing has an empty cavity, an air inlet is formed on one side of the empty cavity, an air outlet is formed on the other side thereof, a gesture control assembly is installed at the inner upper end of the housing, a hot air heating assembly configured for mixing hot and cold air is installed inside the empty cavity, the hot air heating assembly has a separate heating chamber, and one end of the heating chamber is connected to the air inlet, and the other end thereof is connected to the air outlet.

10 Claims, 7 Drawing Sheets

(56) References Cited

FOREIGN PATENT DOCUMENTS

| | | | |
|---|---|---|---|
| CN | 212338378 | U | 1/2021 |
| CN | 214248446 | U | 9/2021 |
| CN | 113693476 | A | 11/2021 |
| JP | 2001140305 | A | 5/2001 |

* cited by examiner

NOISE-REDUCING INSTANT HEATING AND DRYING-TYPE FAUCET

CROSS-REFERENCE TO RELATED APPLICATIONS

This application is a continuation of co-pending International Patent Application No. PCT/CN2022/091429, filed on May 7, 2022, which claims the priority and benefit of Chinese patent application number 202210466009.6, filed on Apr. 29, 2022 with China National Intellectual Property Administration, the entire contents of which are incorporated herein by reference.

TECHNICAL FIELD

The present disclosure relates to the technical field of daily necessities, and particularly relates to a noise-reducing instant heating and drying-type faucet.

BACKGROUND

A faucet is a switch used to control the flow of water. With rapid upgrading and replacement, faucets are developed from those made by an old-fashioned cast iron process into electroplating knob-type ones, then into stainless steel single-temperature single-control ones, stainless steel dual-temperature dual-control ones, kitchen semi-automatic ones, instant heating ones and the like. However, none of faucets on the market has a drying function, therefore, a separate apparatus has to be used for drying, which occupies a large space and is expensive to use, in such a case, a faucet with drying function comes into being.

For example, a multi-functional induction-type faucet structure disclosed in Chinese patent literature (Publication No.: CN214248446U) includes a housing and a water outlet assembly, where the housing includes a vertical part and a horizontal part, and an installation channel is arranged inside the housing; the water outlet assembly includes a spray head, a water outlet pipe, a solenoid valve and a first inductive switch, where the spray head is provided with a water outlet communicated with the installation channel, the water outlet pipe is arranged inside the installation channel, the water outlet is in threaded connection with one end of the water outlet pipe, and the other end thereof is connected to the solenoid valve; an air outlet channel is arranged inside the housing, the spray head is provided with an air outlet correspondingly communicated with the air outlet, an air inlet of the air outlet channel is communicated with a rear installation groove, and a drying module is arranged inside the rear installation groove.

In the above structure, because the air outlet channel is too long and adjacent to the water outlet pipe, and the heating assembly is far away from the air outlet, hot air needs to pass through the entire air outlet channel to be emitted, which makes the temperature of the air outlet channel reduce easily and loses more heat of the hot air in the water outlet process, so that the faucet suffers an overall low heat utilization rate.

SUMMARY

In order to overcome defects in the prior art, the present disclosure provides a noise-reducing instant heating and drying-type faucet, so as to solve the problems mentioned in the above background art.

A technical solution adopted by the present disclosure for solving the technical problem is as follows: a noise-reducing instant heating and drying-type faucet, including:

- a water inlet device, where a knob configured for switching between hot and cold water is arranged at one side of the water inlet device, and a water inlet threaded pipe is arranged at the lower end of the water inlet device;
- a hot air water outlet device, where the hot air outlet device is located at the upper end of the water inlet device, the hot air water outlet device includes a housing, the housing has an empty cavity, an air inlet is formed on one side of the empty cavity, an air outlet is formed on the other side thereof, a gesture control assembly is installed at the inner upper end of the housing, a hot air heating assembly configured for mixing hot and cold air is installed inside the empty cavity, the hot air heating assembly has a separate heating chamber, one end of the heating chamber is connected to the air inlet, and the other end thereof is connected to the air outlet;
- a filter cap assembly, where the filter cap assembly is located at the outer side of the air inlet, the filter cap assembly includes an air inlet cap installed at the outer side of the air inlet, a first filter screen and a second filter screen are installed inside the air inlet cap; and
- a bubbler is arranged at the lower end of the empty cavity, and the bubbler is communicated with the water inlet device through a hose.

The present disclosure has the beneficial effects:

1. the hot air water outlet device is arranged at the upper end of the water inlet device, the length of air duct is shortened by making the air enter from one end of the empty cavity and exit from the other end thereof, meanwhile, the hot air heating assembly configured for mixing hot and cold air is installed inside the empty cavity, so as to facilitate the mixing of hot and cold air in the empty cavity and improve the volume of air outlet, which can effectively use heat and prevent heat loss, and improve the heat utilization rate of the faucet;
2. the filter cap assembly can be used to prevent foreign matters and dust from entering the empty cavity to affect the service life of the faucet; and
3. the bubbler is communicated with the water inlet device through a hose to prevent water from being directly filled up the housing or from contacting with the housing, thereby taking away the internal temperature and preventing heat loss.

Further, the hot air heating assembly includes:

- a motor mounting cylinder, where the mounting ring connected to the air inlet is arranged at one end of the motor mounting cylinder, the air suction motor is installed inside one end of the motor mounting cylinder near the mounting ring, and a hot air PCB control board is installed inside the other end thereof; and
- a hot air heating cylinder, where the hot air heating cylinder is located at one end of the motor mounting cylinder away from the mounting ring, the hot air heating cylinder and motor mounting cylinder are mutually communicated with each other to form the heating chamber, a hot-cold air mixing heating part is inserted and mounted inside the hot air heating cylinder, a plurality of air ducts for mixing hot and cold air are thus formed between the hot-cold air mixing heating part and the hot air heating cylinder, a hot air outlet is arranged at one end of the hot air heating cylinder away from the motor mounting cylinder, and the hot air outlet is communicated with the air outlet.

After the above further structure is adopted, air is sucked into the motor mounting cylinder through the air suction motor, cold air is then entered into the hot air heating cylinder, a part of the cold air is heated by the hot-cold air mixing heating part, the remaining part of the cold air is preheated and mixed with the heated air in the air ducts, and the mixed warm air is then output from the air outlet, such structure can greatly shorten the flow distance of the air, make good use of the heat and prevent heat loss.

Further, the cross section of the hot air heating cylinder is a transverse trapezoid, a raised clamping wall is arranged at one end of the inner wall of the hot air heating cylinder near the motor mounting cylinder, the clamping wall is in contact with the outer wall of the hot-cold air mixing heating part and is clamped onto the hot-cold air mixing heating part for fixation, a hot air guiding hood is installed at one end of the clamping wall away from the motor mounting cylinder, the inner wall of the hot air guiding hood is not in contact with the outer wall of the hot-cold air mixing heating part, a hot air duct is formed between the outer wall of the hot air guiding hood and the inner wall of the hot air heating cylinder, the hot air duct is communicated with the hot air outlet, a plurality of through holes are formed on the outer wall of the hot air guiding hood, an air guiding hood is arranged on the outer cover of the hot air outlet, and a plurality of hot air holes is formed on the lower end of the air guiding hood.

After the above further structure is adopted, the cross section of the hot air heating cylinder is a transverse trapezoid, which is conducive to the insertion and fixation of the hot-cold air mixing heating part, moreover, only a part of the raised clamping wall is provided for playing a role in fixation, and a plurality of air ducts for mixing hot and cold air are thus formed between the hot-cold air mixing heating part and the inner wall of the hot air heating cylinder, allowing a part of cold air to enter the air ducts and to be preheated at the outer side of the hot-cold air mixing heating part, and the remaining part of air cold enters into the hot-cold air mixing heating part for heating and mixes with the preheated air in the air ducts, so as to make better use of the heat of the hot-cold air mixing heating part and improve the utilization rate of heat.

Further, the hot-cold air mixing heating part includes:

a heating wire mounting cylinder, where the heating wire mounting cylinder is a conical cylinder, heating wires are mounted inside the heating wire mounting cylinder, the volume of the conical cylinder gradually shrinks towards the direction of the hot air outlet; and heat conduction fins, where the heat conduction fins are arranged in the length direction of the heating wire mounting cylinder, and are arranged radially on the circumference of the heating wire mounting cylinder, a plurality of ventilation holes are arranged between every two adjacent heat conduction fins, a plurality of ventilation holes are also formed on the heating wire mounting cylinder, outer edges of the heat-conducting fins are inclined surfaces, and partial edges of the heat conduction fins are in contact with the clamping wall, so that the hot-cold air mixing heating part is clamped and fixed.

After the above further structure is adopted, the volume of the conical cylinder gradually shrinks towards the direction of the hot air outlet, so that the volume of inlet air is large and the pressure of outlet air is increased, and the cold air can enter the heating wire mounting cylinder and is in direct contact with the heating wires, thereby improving the heating efficiency in the conical cylinder; the heat conduction fins have a heat conduction phenomenon on the heating wire mounting cylinder, which can be used for preheating the cold air at the outer side of the hot-cold air mixing heating part, while the hot air heated through direct contact with the heating wires is output from the ventilation holes, preliminarily mixed with the preheated air in the air ducts and then conveyed into the hot air guiding hood for further mixing, and finally enters the hot air duct via the through holes for outlet, the utilization rate of heat in the whole process is high, the heat loss can be prevented, and cooperation of the hot air guiding hood with the hot air duct can reduce the noise of outlet air.

Further, the number of the plurality of ventilation holes gradually increases in the direction of the hot air outlet.

After the above further structure is adopted, the air in the conical cylinder can be heated for a longer period of time, and the temperature of air is higher, making the subsequent mixing temperature not too low.

Further, the gesture control assembly includes an upper cover plate arranged at the upper end of the empty cavity, a power board is mounted on the upper end of the upper cover plate, a gesture sensors are arranged on the power board, a power board cover is arranged at the upper end of the power board, and gesture direction arrows corresponding to the gesture sensors are arranged on the power board cover.

After the above further structure is adopted, the gesture sensor can be used to start or close the water inlet process of the water inlet device, and the gesture control assembly is arranged inside the empty cavity, so that the volume and the occupied space of the device is reduced.

Further, an upper housing is arranged at one side of the lower end of the housing, a fixing plate is arranged inside the upper housing, and the water inlet device includes:

a lower housing, where the lower housing is inserted inside the upper housing, and a knob hole is formed on one side of the lower part of the lower housing;

a solenoid valve, where the solenoid valve is located inside the lower housing, the solenoid valve is connected with the gesture sensor wire to control the switching of the solenoid valve through the gesture sensor, the solenoid valve has manual functions, a water flow rate cylinder is connected with the lower end of the solenoid valve, the water inlet threaded pipe is connected with the lower end of the water flow rate cylinder, and the knob is connected with the solenoid valve; and a cast aluminum heating body, where a hot water chamber is arranged inside the cast aluminum heating body, the solenoid valve is communicated with the lower end of the hot water chamber through a connecting pipe, a hot water pipe is installed at the upper end thereof, a threaded head is installed at the upper end of the hot water pipe, the threaded head is in threaded connection with the fixing plate, the threaded head is connected with one end of the hose, and the bubbler is connected with the other end thereof.

After the above further structure is adopted, the housing can be installed with the water inlet device through the upper housing, so that the structure simple and practical structure and the occupied space is less; the solenoid valve with manual functions can be manually switched through the knob, which is of high applicability.

Further, a heat dissipation sleeve is sleeved on the outer side of the solenoid valve, where a silicon controlled rectifier is installed at the outer side of the heat dissipation sleeve, a water flow sensor is arranged inside the water flow rate cylinder, and a Hall sensor connected to the silicon controlled rectifier is installed at the outer side of the water flow rate cylinder.

After the above further structure is adopted, the water flow rate may be sensed by the water flow sensor inside the water flow rate cylinder, so as to automatically shut off the water inlet.

Further, a micro switch is installed at the side of the solenoid valve near the knob, a raised top pressing block is arranged at the inner side of the knob, and the top pressing block corresponds to the micro switch.

After the above further structure is adopted, the micro switch can be used to control the switching of the cast aluminum heating body for heating work; when the knob is rotated to one side, the top pressing block triggers the micro switch, so that hot water releases; when the knob is rotated to the opposite side, the top pressing block does not trigger the micro switch, so that cold water releases.

Further, an infrared sensor is installed at the outer side of the air guiding hood, and the infrared sensor is used to switch on/off the air suction motor and the heating wires.

After the above further structure is adopted, the infrared sensor arranged at the air guiding hood may be future used to switch on the drying function separately, making the operation simple and practicable.

Figure 1:
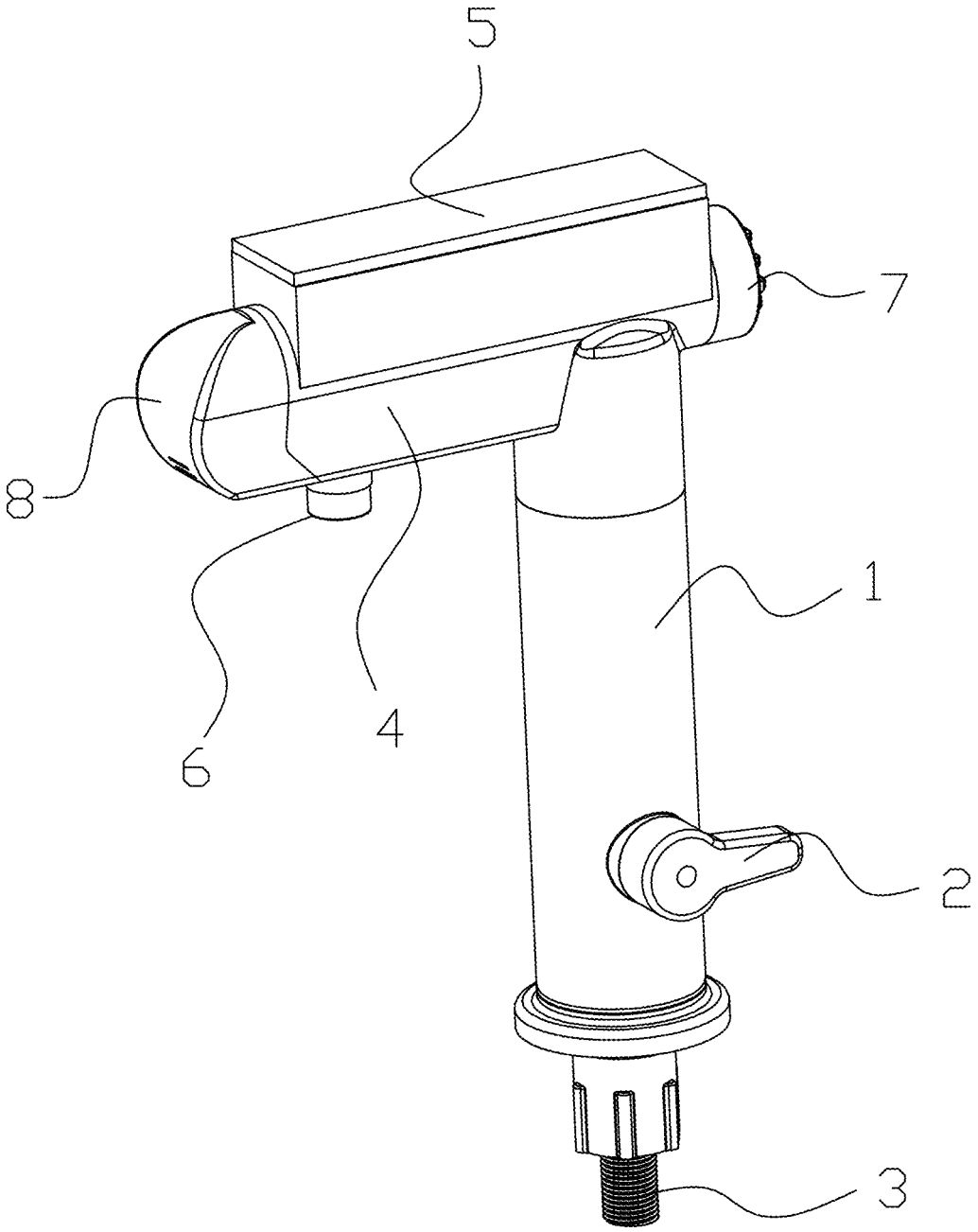
FIG. 1 is a schematic diagram of a three-dimensional structure of a faucet in the present disclosure.
Figure 2:
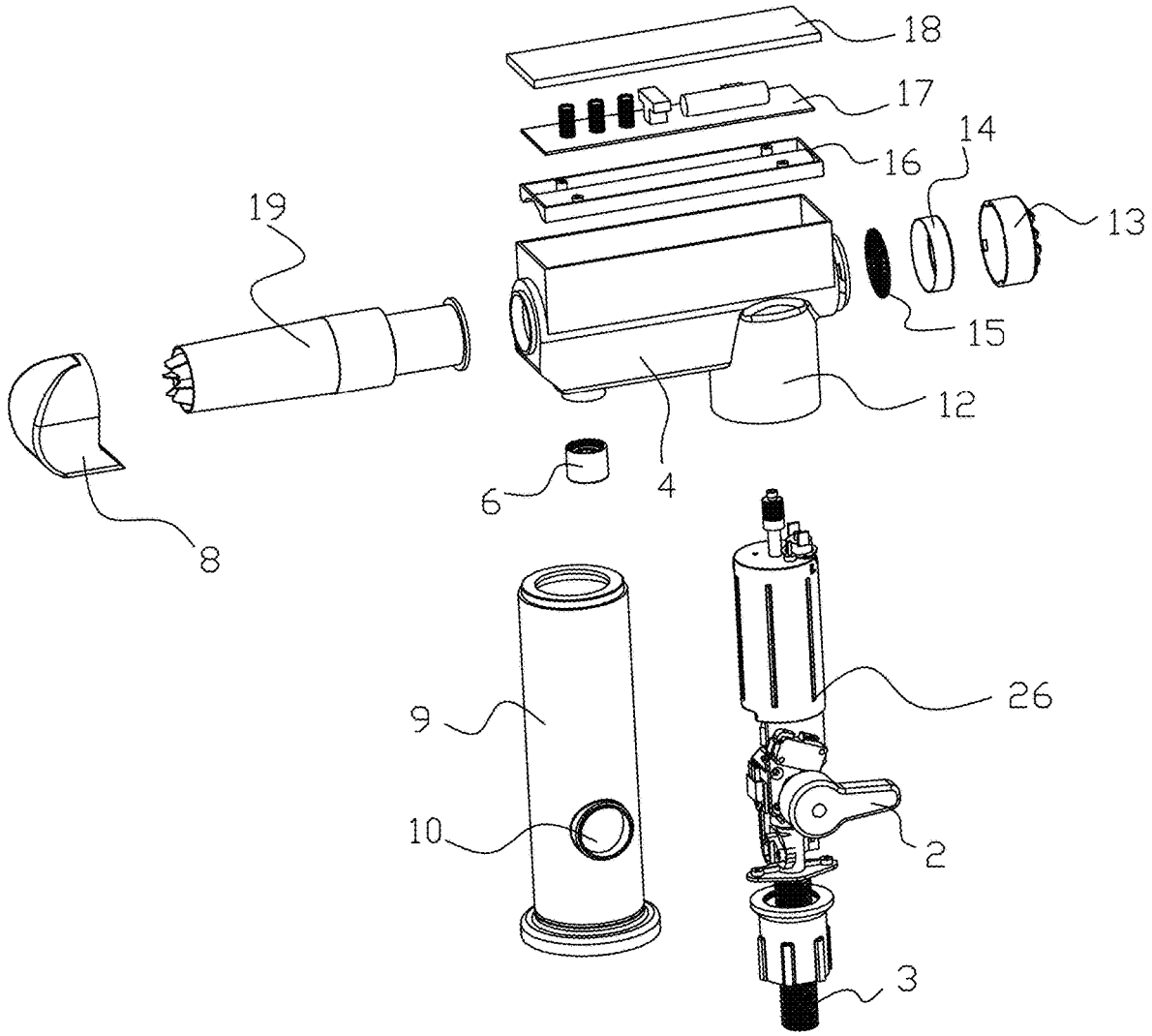
FIG. 2 is a schematic diagram of an exploded structure of a faucet in the present disclosure.
Figure 3:
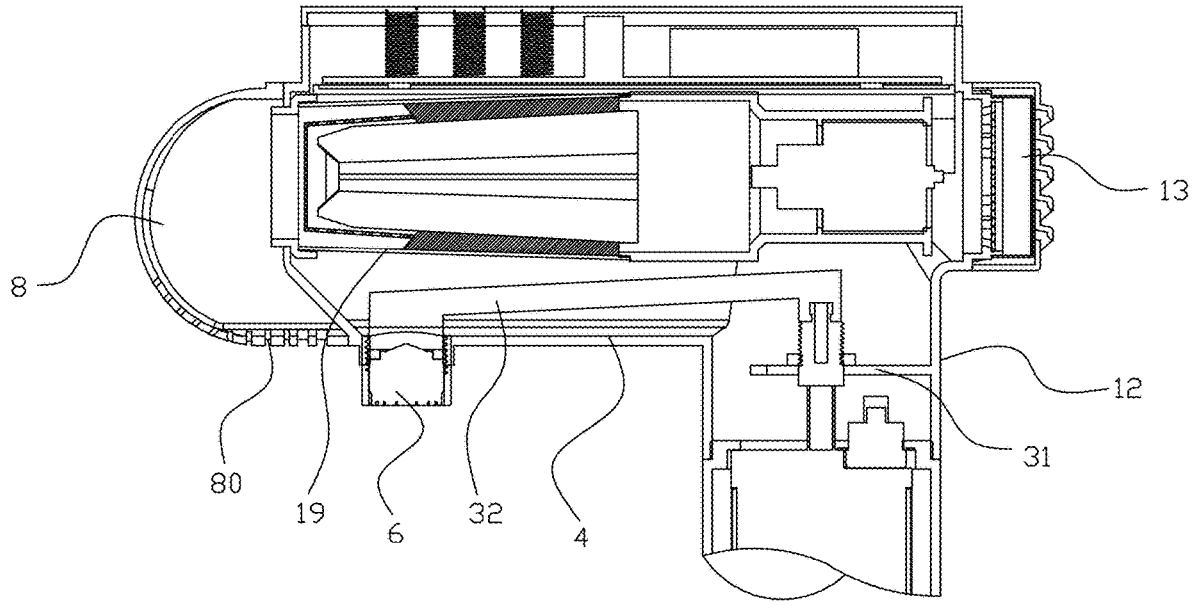
FIG. 3 is a schematic diagram of an internal structure of a housing.

In the figures: water inlet device 1, knob 2, water inlet threaded pipe 3, housing 4, gesture control assembly 5, bubbler 6, filter cap assembly 7, air guiding hood 8, hot air hole 80, lower housing 9, knob hole 10, upper housing 12, air inlet cap 13, first filter screen 14, second filter screen 15, upper cover plate 16, power board 17, power board cover 18, hot air heating assembly 19, water flow rate cylinder 20, solenoid valve 21, heat dissipation sleeve 22, top pressing block 23, micro switch 24, connecting pipe 25, cast aluminum heating body 26, hot water pipe 27, threaded head 28, Hall sensor 29, silicon controlled rectifier 30, fixing plate 31, hose 32, motor mounting cylinder 33, mounting ring 34, hot air heating cylinder 35, air suction motor 36, hot air PCB control board 37, clamping wall 38, hot-cold air mixing heating part 39, heating wire mounting cylinder 390, heat conduction fin 391, hot air guiding hood 40, through hole 41, hot air duct 42, left arrow 43, right arrow 44, infrared sensor 45.

DESCRIPTION OF EMBODIMENTS

The specific implementation of the present disclosure will be further described below with reference to the accompanying drawings: It should be noted that the description of these embodiments is intended to help understand the present disclosure, but does not constitute a limitation of the present disclosure. Further, the technical features involved in each implementation of the present disclosure described below may be combined with one another as long as they do not constitute a conflict with one another.

In combination with FIG. 1-FIG. 5, a noise-reducing instant heating and drying-type faucet is provided, the faucet includes a water inlet device 1, a hot air water outlet device and a filter cap assembly 7, a knob 2 configured for switching between hot and cold water is arranged at one side of the water inlet device 1, and a water inlet threaded pipe 3 is arranged at the lower end of the water inlet device 1; the hot air water outlet device is located at the upper end of the water inlet device 1, the hot air water outlet device includes a housing 4, the housing 4 has an empty cavity, an air inlet is formed on one side of the empty cavity, an air outlet is formed on the other side thereof, a gesture control assembly 5 is installed at the inner upper end of the housing 4, a hot air heating assembly 19 configured for mixing hot and cold air is installed inside the empty cavity, the hot air heating assembly 19 has a separate heating chamber, one end of the heating chamber is connected to the air inlet, and the other end thereof is connected to the air outlet; the hot air water outlet device is arranged at the upper end of the water inlet device 1, the length of air duct is shortened by making the air enter from one end of the empty cavity and exit from the other end thereof, meanwhile, the hot air heating assembly 19 configured for mixing hot and cold air is installed inside the empty cavity, so as to facilitate the mixing of hot and cold air in the empty cavity and improve the volume of air outlet, which can effectively use heat and prevent heat loss, and improve the heat utilization rate of the faucet; and the filter cap assembly 7 is located at the outer side of the air inlet, the filter cap assembly 7 includes an air inlet cap 13 installed at the outer side of the air inlet, a first filter screen 14 and a second filter screen 15 are installed inside the air inlet cap 13, and the filter cap assembly 7 can be used to prevent foreign matters and dust from entering the empty cavity to affect the service life of the faucet.

A bubbler 6 is arranged at the lower end of the empty cavity, and the bubbler 6 is communicated with the water inlet device 1 through a hose 32 to prevent water from being directly filled up the housing 4 or from contacting with the housing 4, thereby taking away the internal temperature and preventing heat loss.

Figure 4:
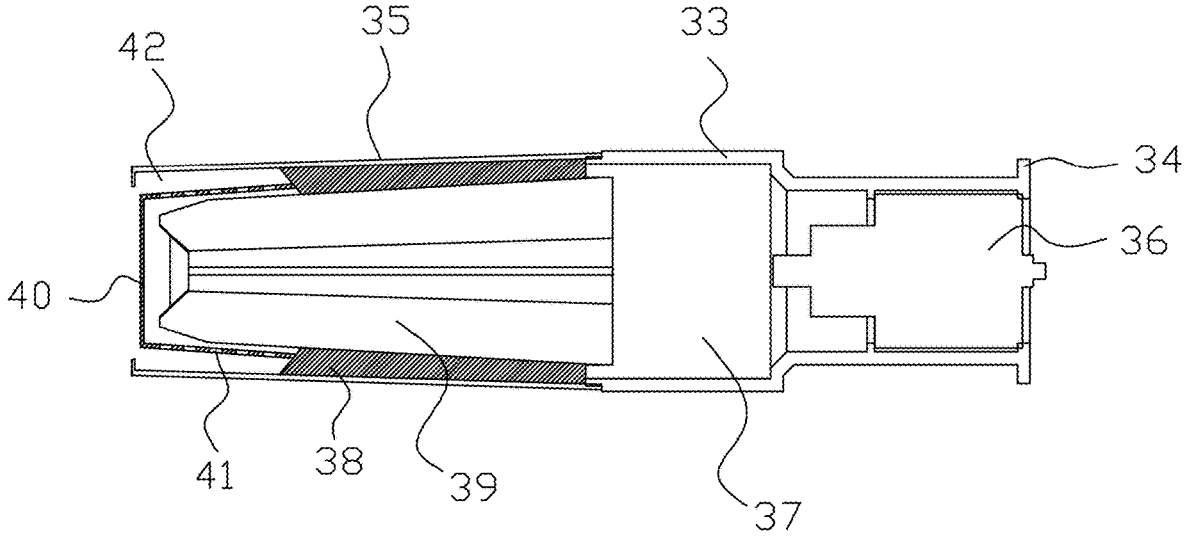
FIG. 4 is a schematic structural diagram of a hot air heating assembly.
Figure 5:
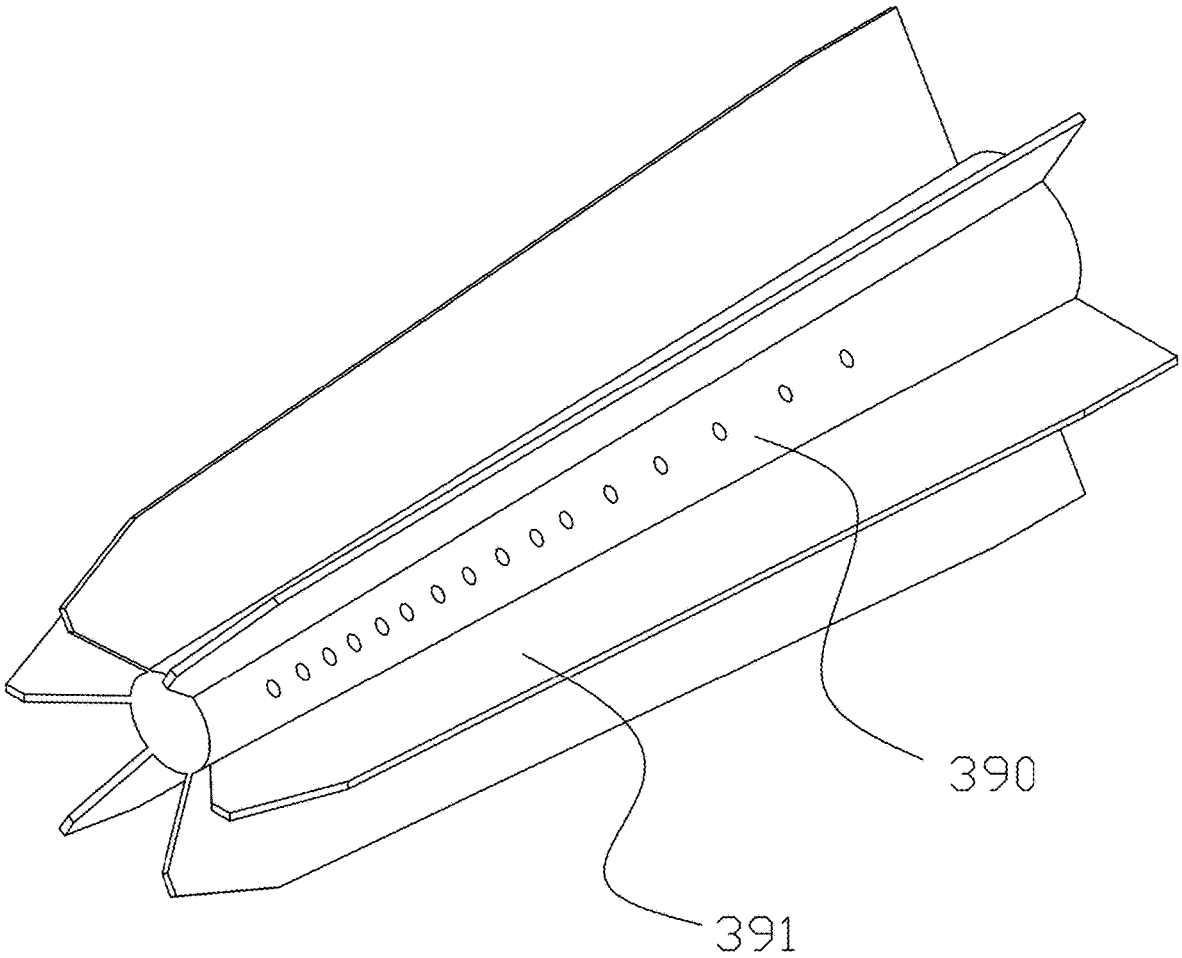
FIG. 5 is a schematic structural diagram of a hot-cold air mixing heating part.

In combination with FIGS. 4 and 5, the hot air heating assembly 19 includes a motor mounting cylinder 33 and a hot air heating cylinder 35, a mounting ring 34 connected to the air inlet is arranged at one end of the motor mounting cylinder 33, an air suction motor 36 is installed inside one end of the motor mounting cylinder 33 near the mounting ring 34, and a hot air PCB control board 37 is installed inside the other end thereof; the hot air heating cylinder 35 is located at one end of the motor mounting cylinder 33 away from the mounting ring 34, the hot air heating cylinder 35 and motor mounting cylinder 33 are mutually communicated with each other to form the heating chamber, a hot-cold air mixing heating part 39 is inserted and mounted inside the hot air heating cylinder 35, a plurality of air ducts for mixing hot and cold air are thus formed between the hot-cold air mixing heating part 39 and the hot air heating cylinder 35, a hot air outlet is arranged at one end of the hot air heating cylinder 35 away from the motor mounting cylinder 33, and the hot air outlet is communicated with the air outlet; the air is sucked into the motor mounting cylinder 33 through the air suction motor 36, the cold air is then entered into the hot air heating cylinder 35, a part of the cold air is heated by the hot-cold air mixing heating part 39, the remaining part of the cold air is preheated and mixed with the heated air in the air ducts, and the mixed warm air is then output from the air outlet, such structure can greatly shorten the flow distance of the air, make good use of the heat and prevent heat loss.

As shown in FIG. 4, the cross section of the hot air heating cylinder 35 is a transverse trapezoid, a raised clamping wall 38 is arranged at one end of the inner wall of the hot air heating cylinder 35 near the motor mounting cylinder 33, the clamping wall 38 is in contact with the outer wall of the hot-cold air mixing heating part 39 and is clamped onto the hot-cold air mixing heating part 39 for fixation, a hot air guiding hood 40 is installed at one end of the clamping wall 38 away from the motor mounting cylinder 33, the inner wall of the hot air guiding hood 40 is not in contact with the outer wall of the hot-cold air mixing heating part 39, a hot air duct 42 is formed between the outer wall of the hot air guiding hood 40 and the inner wall of the hot air heating cylinder 35, the hot air duct 42 is communicated with the hot air outlet, a plurality of through holes 41 are formed on the outer wall of the hot air guiding hood 40, an air guiding hood 8 is arranged on the outer cover of the hot air outlet, and a plurality of hot air holes 80 is formed on the lower end of the air guiding hood 8; the cross section of the hot air heating cylinder 35 is a transverse trapezoid, which is conducive to the insertion and fixation of the hot-cold air mixing heating part 39, moreover, only a part of the raised clamping wall 38 is provided for playing a role in fixation, and a plurality of air ducts for mixing hot and cold air are thus formed between the hot-cold air mixing heating part 39 and the inner wall of the hot air heating cylinder 35, allowing a part of cold air to enter the air ducts and to be preheated at the outer side of the hot-cold air mixing heating part 39, and the remaining part of air cold enters into the hot-cold air mixing heating part 39 for heating and mixes with the preheated air in the air ducts, so as to make better use of the heat of the hot-cold air mixing heating part 39 and improve the utilization rate of heat.

As shown in FIG. 5, the hot-cold air mixing heating part 39 includes a heating wire mounting cylinder 390 and heat conduction fins 391, the heating wire mounting cylinder 390 is a conical cylinder, heating wires are mounted inside the heating wire mounting cylinder 390, and the volume of the conical cylinder gradually shrinks towards the direction of the hot air outlet, so that the volume of inlet air is large and the pressure of outlet air is increased, and the cold air can enter the heating wire mounting cylinder 390 and is in direct contact with the heating wires, thereby improving the heating efficiency in the conical cylinder.

The heat conduction fins 391 are arranged in the length direction of the heating wire mounting cylinder 390, and are arranged radially on the circumference of the heating wire mounting cylinder 390, a plurality of ventilation holes are arranged between every two adjacent heat conduction fins 391, a plurality of ventilation holes are also formed on the heating wire mounting cylinder 390, outer edges of the heat-conducting fins 391 are inclined surfaces, and partial edges of the heat conduction fins 391 are in contact with the clamping wall 38, so that the hot-cold air mixing heating part 39 is clamped and fixed; the heat conduction fins 391 have a heat conduction phenomenon on the heating wire mounting cylinder 390, which can be used for preheating the cold air at the outer side of the hot-cold air mixing heating part 39, while the hot air heated through direct contact with the heating wires is output from the ventilation holes, preliminarily mixed with the preheated air in the air ducts and then conveyed into the hot air guiding hood 40 for further mixing, and finally enters the hot air duct 42 via the through holes 41 for outlet, the utilization rate of heat in the whole process is high, the heat loss can be prevented, and cooperation of the hot air guiding hood 40 with the hot air duct 42 can reduce the noise of outlet air.

The number of the plurality of ventilation holes gradually increases in the direction of the hot air outlet, so that the air in the conical cylinder can be heated for a longer period of time, and the temperature of air is higher, making the subsequent mixing temperature not too low.

Figure 6:
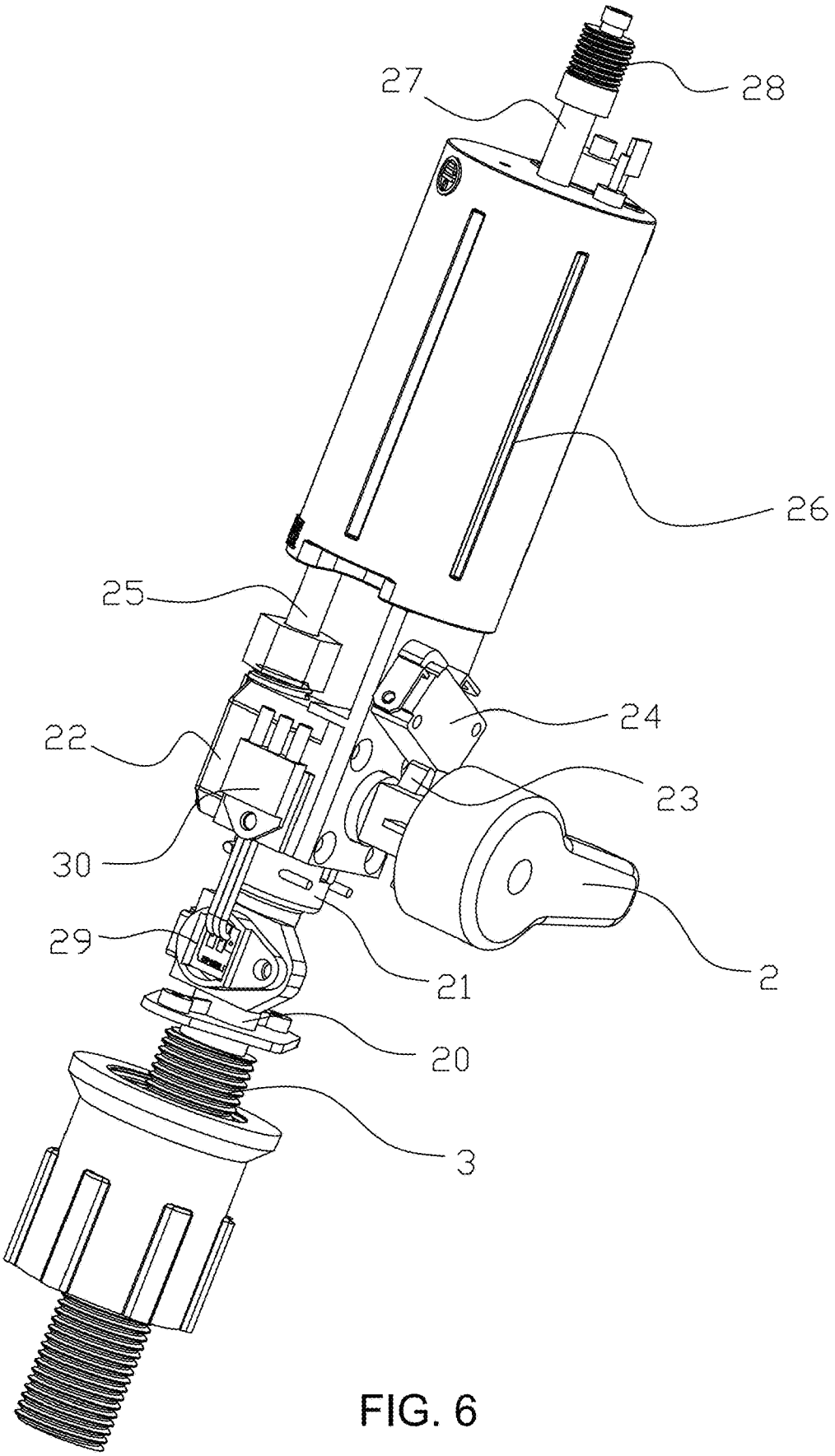
FIG. 6 is a schematic diagram of a three-dimensional structure of a water inlet device.
Figure 7:
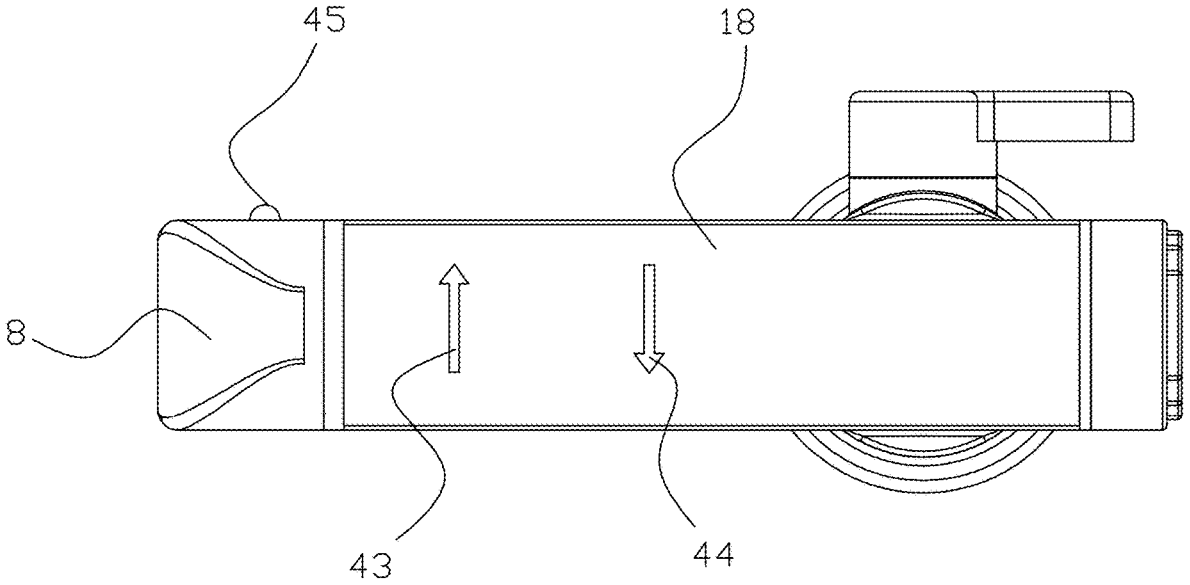
FIG. 7 is a structural schematic diagram from a top view of a faucet in the present disclosure.

In combination with FIGS. 1, 6 and 7, the gesture control assembly 5 includes an upper cover plate 16 arranged at the upper end of the empty cavity, a power board 17 is mounted on the upper end of the upper cover plate 16, a gesture sensors are arranged on the power board 17, a power board cover 18 is arranged at the upper end of the power board 17, and gesture direction arrows corresponding to the gesture sensors are arranged on the power board cover 18; the gesture sensor can be used to start or close the water inlet process of the water inlet device, and the gesture control assembly 5 is arranged inside the empty cavity, so that the volume and the occupied space of the device is reduced.

An upper housing 12 is arranged at one side of the lower end of the housing 4, a fixing plate 31 is arranged inside the upper housing 12, the water inlet device 1 includes a lower housing 9, a solenoid valve 21 and a cast aluminum heating body 26 for heating water flow, the lower housing 9 is inserted inside the upper housing 12, and a knob hole 10 is formed on one side of the lower part of the lower housing 9; the solenoid valve 21 is located inside the lower housing 9, the solenoid valve 21 is connected with the gesture sensor wire to control the switching of the solenoid valve through the gesture sensor, the solenoid valve 21 has manual functions, a water flow rate cylinder 20 is connected with the lower end of the solenoid valve 21, the water inlet threaded pipe 3 is connected with the lower end of the water flow rate cylinder 20, and the knob 2 is connected with the solenoid valve 21.

A hot water chamber is arranged inside the cast aluminum heating body 26, the solenoid valve 21 is communicated with the lower end of the hot water chamber through a connecting pipe 25, a hot water pipe 27 is installed at the upper end thereof, a threaded head 28 is installed at the upper end of the hot water pipe 27, the threaded head 28 is in threaded connection with the fixing plate 31, the threaded head 28 is connected with one end of the hose 32, and the bubbler 6 is connected with the other end thereof.

The housing 4 can be installed inside the water inlet device 1 through the upper housing 12, so that the structure simple and practical structure and the occupied space is less; the solenoid valve with manual functions can be manually switched through the knob 2, which is of high applicability.

As shown in FIG. 6, a heat dissipation sleeve 22 is sleeved on the outer side of the solenoid valve 21, a silicon controlled rectifier 30 is installed at the outer side of the heat dissipation sleeve 22, a water flow sensor is arranged inside the water flow rate cylinder 20, and a Hall sensor 29 connected to the silicon controlled rectifier 30 is installed at the outer side of the water flow rate cylinder 20; the water flow rate may be sensed by the water flow sensor inside the water flow rate cylinder 20, so as to automatically shut off the water inlet.

A micro switch 24 is installed at the side of the solenoid valve 21 near the knob 2, a raised top pressing block 23 is arranged at the inner side of the knob 2, the top pressing block 23 corresponds to the micro switch 24, and the micro switch 24 can be used to control the switching of the cast aluminum heating body 26 for heating work; when the knob 2 is rotated to one side, the top pressing block 23 triggers the micro switch 24, so that hot water releases; when the knob 2 is rotated to the opposite side, the top pressing block 23 does not trigger the micro switch 24, so that cold water releases.

An infrared sensor 45 is installed at the outer side of the air guiding hood 8, the infrared sensor 45 is used to switch on/off the air suction motor 36 and the heating wires, and the infrared sensor 45 arranged at the air guiding hood 8 may be future used to switch on the drying function separately, making the operation simple and practicable. As shown in FIG. 7, two gesture sensors are separately arranged at a left arrow 43 and a right arrow 44 on the power board cover 18 and correspond to the gesture sensing areas respectively. When the gesture moves from right to left, the water will release and the cast aluminum heating body 26 will be switched on, and when the gesture moves in the repeated direction, no water will release and the cast aluminum heating body 26 will be switched off; when the gesture moves from left to right, only cold water releases while the cast aluminum heating body 26 does not work, and the water can be turned off under the condition of repeating the gesture.

In this embodiment, a water outlet NTC may be further installed to control and adjust the water temperature. The air suction motor 36 adopts a DC frequency conversion motor with a rotating speed of 10W, and the structure of hot air guiding hood 40 and the hot air duct 42 can further reduce noise.

It should be noted that the relevant control circuit in this embodiment is prior art and will not be further described here.

The embodiments of the present disclosure have been described in detail above with reference to the accompanying drawings, but the present disclosure is not limited to the described embodiments. It will be apparent to those skilled in the art that various changes, modifications, substitutions and alterations may be made to these embodiments without departing from the principles and spirit of the disclosure, which fall within the protection scope of the present disclosure.

What is claimed is:

1. A noise-reducing instant heating and drying-type faucet, comprising:

a water inlet device, a knob configured for switching between hot and cold water is arranged at one side of the water inlet device, and a water inlet threaded pipe is arranged at a lower end of the water inlet device;

a hot air water outlet device, wherein the hot air water outlet device is located at an upper end of the water inlet device, the hot air water outlet device comprises a housing, the housing has cavity, an air inlet is formed on one side of the cavity, an air outlet is formed on the other side thereof, a gesture control assembly is installed at an inner upper end of the housing, a hot air heating assembly configured for mixing hot and cold air is installed inside the cavity, the hot air heating assembly has a separate heating chamber, one end of the heating chamber is connected to the air inlet, and the other end thereof is connected to the air outlet;

a filter cap assembly, wherein the filter cap assembly is located at an outer side of the air inlet, the filter cap assembly comprises an air inlet cap installed at an outer side of the air inlet, a first filter screen and a second filter screen are installed inside the air inlet cap;

a bubbler is arranged at a lower end of the cavity, and the bubbler is connected with the water inlet device through a hose;

the hot air heating assembly comprises:

a motor mounting cylinder, an air suction motor is installed inside the motor mounting cylinder; and a hot air heating cylinder, wherein the hot air heating cylinder is located at one end of the motor mounting cylinder away from a mounting ring, the hot air heating cylinder and motor mounting cylinder are connected with each other to form the heating chamber, a hot-cold air mixing heating part is inserted and mounted inside the hot air heating cylinder, a plurality of air ducts for mixing hot and cold air are thus formed between the hot-cold air mixing heating part and the hot air heating cylinder, a hot air outlet is arranged at one end of the hot air heating cylinder away from the motor mounting cylinder, and the hot air outlet is connected with the air outlet.

2. The noise-reducing instant heating and drying-type faucet according to claim 1, wherein the mounting ring connected to the air inlet is arranged at one end of the motor mounting cylinder, the air suction motor is installed inside one end of the motor mounting cylinder near the mounting ring, and a hot air PCB control board is installed inside an another end of the motor mounting cylinder.

3. The noise-reducing instant heating and drying-type faucet according to claim 2, wherein a cross section of the hot air heating cylinder is a transverse trapezoid, a raised clamping wall is arranged at one end of an inner wall of the hot air heating cylinder near the motor mounting cylinder, the clamping wall is in contact with an outer wall of the hot-cold air mixing heating part and is clamped onto the hot-cold air mixing heating part for fixation, a hot air guiding hood is installed at one end of the clamping wall away from the motor mounting cylinder, an inner wall of the hot air guiding hood is not in contact with the outer wall of the hot-cold air mixing heating part, a hot air duct is formed between an outer wall of the hot air guiding hood and the inner wall of the hot air heating cylinder, the hot air duct is connected with the hot air outlet, a plurality of through holes are formed on the outer wall of the hot air guiding hood, an air guiding hood is arranged on an outer cover of the hot air outlet, and a plurality of hot air holes is formed on a lower end of the air guiding hood.

4. The noise-reducing instant heating and drying-type faucet according to claim 3, wherein the hot-cold air mixing heating part comprises:

a heating wire mounting cylinder, wherein the heating wire mounting cylinder is a conical cylinder, heating wires are mounted inside the heating wire mounting cylinder, a volume of the conical cylinder gradually shrinks towards a direction of the hot air outlet; and heat conduction fins, wherein the heat conduction fins are arranged in a length direction of the heating wire mounting cylinder, and are arranged radially on a circumference of the heating wire mounting cylinder, a plurality of ventilation holes are arranged between every two adjacent heat conduction fins, the plurality of ventilation holes are also formed on the heating wire mounting cylinder, outer edges of the heat-conducting fins are inclined surfaces, and partial edges of the heat conduction fins are in contact with the clamping wall, so that the hot-cold air mixing heating part is clamped and fixed.

5. The noise-reducing instant heating and drying-type faucet according to claim 4, wherein the plurality of ventilation holes gradually increases in the direction of the hot air outlet.

6. The noise-reducing instant heating and drying-type faucet according to claim 1, wherein the gesture control assembly comprises an upper cover plate arranged at an upper end of the cavity, a power board is mounted on an upper end of the upper cover plate, gesture sensors are arranged on the power board, a power board cover is arranged at an upper end of the power board, and gesture direction arrows corresponding to the gesture sensors are arranged on the power board cover.

7. The noise-reducing instant heating and drying-type faucet according to claim 6, wherein an upper housing is arranged at one side of a lower end of the housing, a fixing plate is arranged inside the upper housing, the water inlet device comprises:

a lower housing, wherein the lower housing is inserted inside the upper housing, and a knob hole is formed on one side of a lower part of the lower housing;

a solenoid valve, wherein the solenoid valve is located inside the lower housing, the solenoid valve is connected with a gesture sensor wire to control a switching of the solenoid valve through the gesture sensors, the solenoid valve has manual functions, a water flow rate cylinder is connected with a lower end of the solenoid valve, the water inlet threaded pipe is connected with a lower end of the water flow rate cylinder, and the knob is connected with the solenoid valve; and a cast aluminum heating body, wherein a hot water chamber is arranged inside the cast aluminum heating body, the solenoid valve is connected with a lower end of the hot water chamber through a connecting pipe, a hot water pipe is installed at an upper end of the hot water chamber, a threaded head is installed at an upper end of the hot water pipe, the threaded head is in threaded connection with the fixing plate, the threaded head is connected with one end of the hose, and the bubbler is connected with the other end thereof.

8. The noise-reducing instant heating and drying-type faucet according to claim 7, wherein a heat dissipation sleeve is sleeved on an outer side of the solenoid valve, a silicon controlled rectifier is installed at an outer side of the heat dissipation sleeve, a water flow sensor is arranged inside the water flow rate cylinder, and a Hall sensor connected to the silicon controlled rectifier is installed at an outer side of the water flow rate cylinder.

9. The noise-reducing instant heating and drying-type faucet according to claim 8, wherein a micro switch is installed at one side of the solenoid valve near the knob, a raised top pressing block is arranged at an inner side of the knob, the top pressing block corresponds to the micro switch.

10. The noise-reducing instant heating and drying-type faucet according to claim 3, wherein an infrared sensor is installed at an outer side of the air guiding hood, and the infrared sensor is used to switch on/off the air suction motor and the heating wires.

* * * * *